United States Patent [19]

Beckisk

[11] 3,953,035

[45] Apr. 27, 1976

[54] GOLF CLUB SWING TRAINING DEVICE

[76] Inventor: John Beckisk, 228 W. Mitchell St., Milwaukee, Wis. 53204

[22] Filed: Dec. 2, 1974

[21] Appl. No.: 528,914

[52] U.S. Cl. ..... 273/192; 273/194 R

[51] Int. Cl.[2] ..... A63B 69/36

[58] Field of Search ..... 273/191, 192, 186, 183

[56] References Cited

UNITED STATES PATENTS

| | | | |
|---|---|---|---|
| 3,795,399 | 3/1974 | Beckish | 273/191 A |
| 3,806,133 | 4/1974 | Coleman | 273/192 |

*Primary Examiner*—George J. Marlo

*Attorney, Agent, or Firm*—Richard P. Ulrich

[57] ABSTRACT

A golf club or putter connected to a swing guide mechanism which is maintained in contact with a arcuate guide and support track defining a desired golf club or putter swing path. The guide track is supported on two vertical standards which provide elevation to the track. The arcuate track is a flat bar linear in the middle portion and curved upward at each end portion. The support track being similar in configuration to the guide track and located approximately parallel to and below the guide bar track provides inclination to the golf club as the club traverses the guide track. The guide mechanism located on the guide bar track which encompasses a portion of the golf club shaft consist of a housing that incases cantilever plastic snubbers which give definition to the guide mechanism as it transverses the guide track.

7 Claims, 6 Drawing Figures

GOLF CLUB SWING TRAINING DEVICE

SUMMARY OF THE INVENTION

A golf club pitch and putt swing training device including a base frame laying at ground level surrounding both feet, two manually operative and thread adjusting rods, each mounted in a vertical standard fixed to the base, an arcuate flat bar guide track linear over the center portion and curved upward at each end portion, supported by adjusting rods which elevate the guide track vertically, pivots located between the guide track and the adjusting rods to provide inclination to the guide track, and a slide mechanism located on the guide track supporting the golf club and providing guidance for a reciprocating swing. A support track being similar in configuration to the guide track located approximately equidistant to and below the guide bar track mounted on two pivotable clevis each supported by a pivotable arm, attached to the vertical standard, a link supporting the pivotable arm on one end and releasably attached to a slot on the vertical standard on the opposite end.

DETAILED DESCRIPTION

Figure 1:
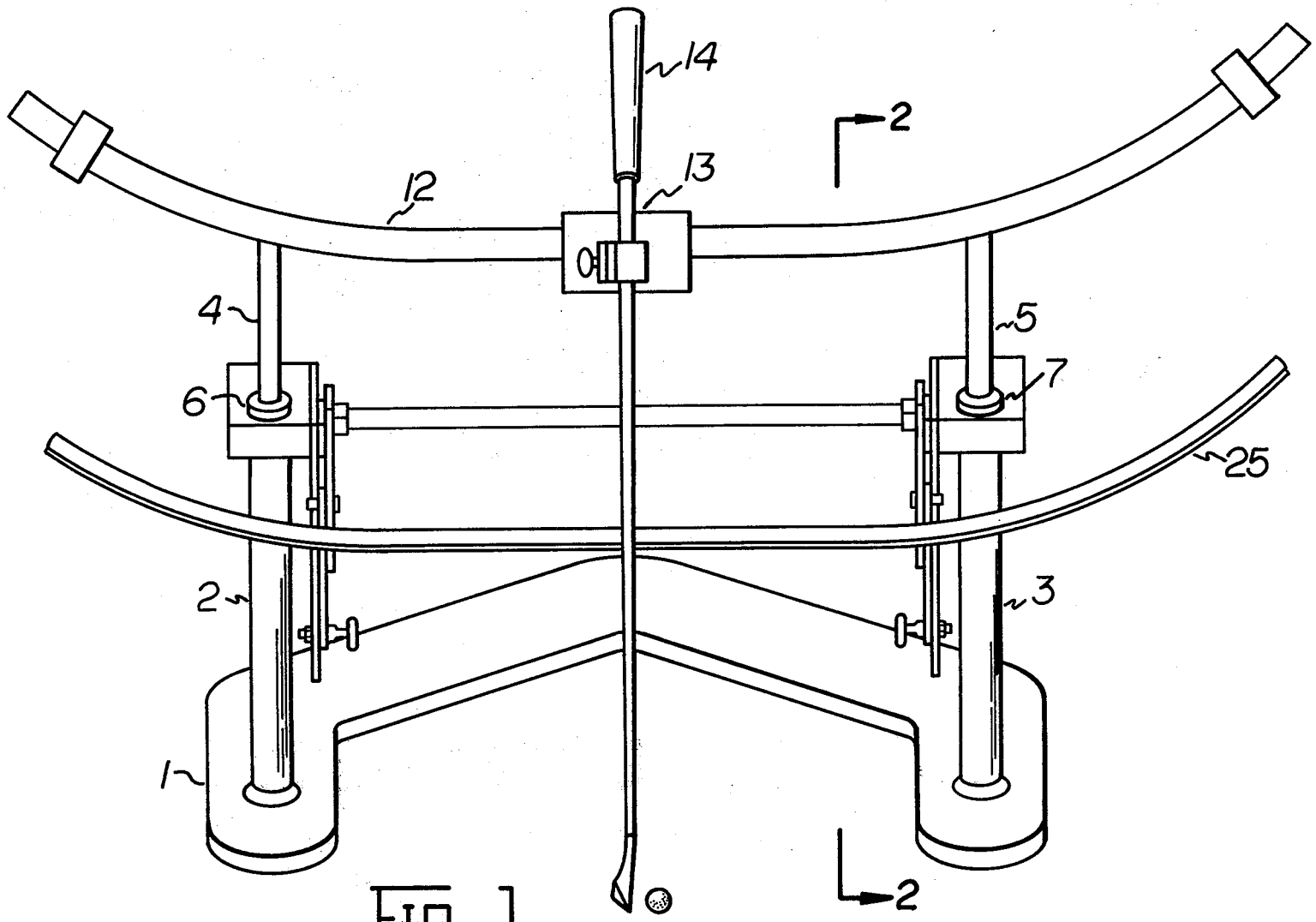
FIG. 1 is a perspective view taken from the front of the golf pitch and putt swing training device.
Figure 5:
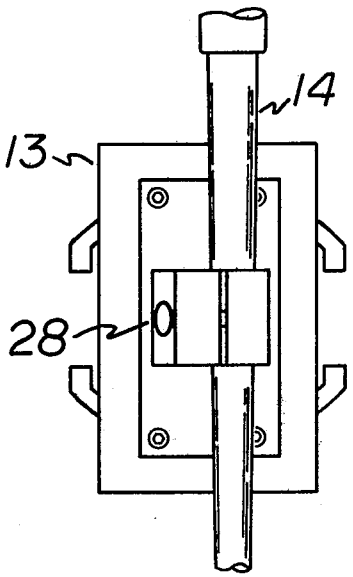
FIG. 5 is a frontal view of the guide mechanism.
Figure 6:
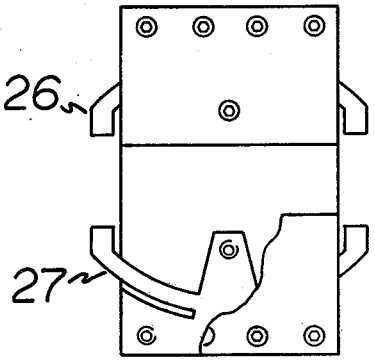
FIG. 6 is a fragmentary view of the guide mechanism.
Figure 4:
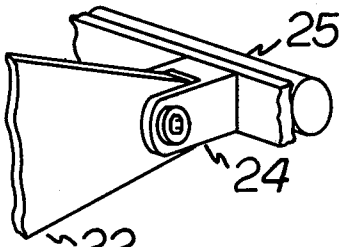
FIG. 4 is a fragmentary view of the inclination adjustment on the support track.
Figure 2:
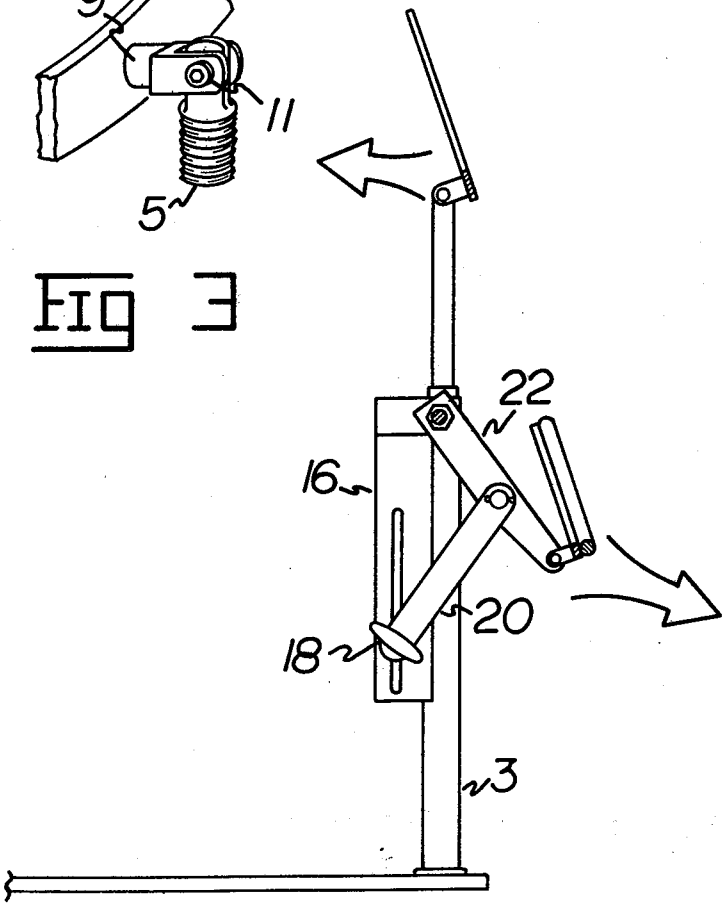
FIG. 2 is a sectional side view of the adjustments on the guide and support track.
Figure 3:
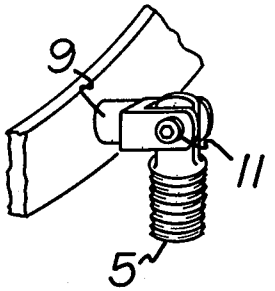
FIG. 3 is a fragmentary view of the inclination adjustment on the guide track.

A simple base frame 1 supports two standards 2, 3 which in turn supports a golf club swing guide track 12 and a support track 25. The standards 2, 3 are relatively short and are vertically fixed in the base frame.

The standards 2 and 3 have internal telescoping rods 4 and 5 each of which may be adjusted upward and releasably secured by the lock nuts 6 and 7. The vertical adjustable rods 4 and 5 are connected to guide track 12 by means of pivot members 9. Locking screws 11 located in the pivot members, 9 fix the inclination of the track.

Releasable wing nuts 18 engage slots 16 located on the vertical standards 2, 3 and secure links 20 which are attached to pivotable arms 22. The pivoting ends of the pivotable arms 22 are located on the vertical standard 2, 3. Pivotable clevises 24, attached to the support track 25, are located on the opposite ends of the pivotable arms 22. Guide mechanism 13 is engaged with guide track 12 and yields to the contour of the track. Guide mechanism 13 partially consists of cantilever plastic snubbers 26, 27 which bear against the guide bar track and a releasably secured clevis 28 that encompasses a portion of a golf club shaft. In use, a golf club 14 is engaged with guide mechanism 13. (The club may be easily disengaged for swing comparison.) The trainer then adjusts the device with regard to proper positioning, the height, and the frame structure of the trainee to arrive at a suitable swing path for the trainee. When the correct adjustment has been made, the trainee repeats the swing with the device until he habitually conforms to the movement.

Having thus described the invention, what is claimed and desired to be secured by Letters Patent of the United States is:

1. A golf pitch and putt swing training device comprising: a base frame; vertical standards fixed to said base frame; vertical rods in the standards movable vertically for height adjustment; pivot fittings at the top of said rods for inclination; a guide track linear in the center portion and curved upwards at the end portions in one plane only fixed on said pivot fittings; a guide mechanism engaged with said guide track; and a support track, similar in configuration to the guide track, located approximately parallel to and below the guide track, mounted on pivotable clevises supported by pivotable arms which are attached to said vertical standards.

2. A device as in claim 1 and an adjustment means for moving each of said pivotable arms and clevises rotationally and independently to afford adjustment of the path defined by said support track.

3. A training device as in claim 1 wherein said guide mechanism is adapted to engage a portion of a golf club and partially consists of cantilever plastic snubbers which bear against the guide track.

4. A training device as in claim 1 wherein said guide mechanism includes a releasably secured clevis adapted to engage a portion of a golf club shaft.

5. A golf pitch and putt swing training device comprising a base frame; a guide track; a plurality of standards; means for pivotally connecting said guide track to said standards means for adjusting said guide track vertically to afford adjustment of the path defined by said guide track, guide means movable on said guide track and adapted to connect a golf club to said guide track to afford guided movement of the golf club, and support track means similar in configuration to the guide track adjustably attached to the standards below the guide track so that the lower portion of the golf club may be supported during the swing.

6. A device as in claim 5 and an adjustment means for moving the opposite ends of said support track and independently to afford adjustment of the path defined by said support track.

7. The device of claim 5 wherein said guide means include plastic snubbers adapted to bear against the guide track.

* * * * *